United States Patent [19]

Hood

[11] 4,311,079

[45] Jan. 19, 1982

[54] METHOD AND APPARATUS USING AIR JETS FOR MANUFACTURING FAIRED ARTICLES

[75] Inventor: Henry A. Hood, Moorestown, N.J.

[73] Assignee: Wall Industries, Inc., Beverly, N.J.

[21] Appl. No.: 181,182

[22] Filed: Aug. 25, 1980

[51] Int. Cl.[3] ..... D04C 1/12; D04C 3/12; D07B 1/14

[52] U.S. Cl. ..... 87/6; 87/7; 87/11; 87/29; 87/30

[58] Field of Search ..... 87/5–9, 87/11, 13, 28–30, 33, 41; 57/6

[56] References Cited

U.S. PATENT DOCUMENTS

| | | | |
|---|---|---|---|
| 2,196,900 | 4/1940 | Girard et al. | 87/30 |
| 2,354,212 | 7/1944 | Jeckel | 87/11 |
| 2,494,389 | 1/1950 | Jeckel | 87/11 X |
| 3,391,595 | 7/1968 | Iwai | 87/7 |
| 3,405,598 | 10/1968 | Iwai | 87/7 |
| 3,975,980 | 8/1976 | Hood | 87/6 |
| 4,030,401 | 6/1977 | Hood | 87/6 |

*Primary Examiner*—John Petrakes

*Attorney, Agent, or Firm*—Howson and Howson

[57] ABSTRACT

A faired article comprising a cable having a core surrounded by a braided jacket is provided with at least one row of fairing loops extending lengthwise of the jacket for the purpose of reducing strumming, drag and cable fatigue when the cable is installed underwater. The faired article is manufactured by guiding a length of fairing yarn into proximity with the upstream side of the ring of a braider, entraining the fairing yarn in an air stream directed across the path of movement of the braid yarns inside the braider ring, and causing the fairing yarn entrained therein to pass through the path of movement of the braid yarns as they advance around the braider ring, thereby enabling the braid yarns to form the fairing yarn into loops as the braid yarns form the jacket around the core. Preferred apparatus for practicing the method of the present invention is also disclosed.

11 Claims, 3 Drawing Figures

METHOD AND APPARATUS USING AIR JETS FOR MANUFACTURING FAIRED ARTICLES

FIELD OF THE INVENTION

The present invention relates to cables or ropes having fairings or streamers extending laterally therefrom for the purpose of reducing strumming, drag and cable fatigue when used underwater. More particularly, the present invention relates to an improved method and apparatus for high-speed production of relatively small-diameter faired ropes and cables.

BACKGROUND OF THE INVENTION

In U.S. Pat. No. 4,030,401, issued on June 21, 1977, to the assignee of the present application, there are disclosed faired articles. Such articles include ropes or cables having a series of laterally-extending streamers or fairings which function, when the rope or cable is installed in an undersea environment, to reduce strumming of the cable, generated noise, cable fatigue and drag. Less strumming makes the cable less likely to be attacked by fish, and less noise makes the cable better suited for use with hydrophones.

In U.S. Pat. No. 3,975,980, issued on Aug. 24, 1976 to the assignee of the present application, there is disclosed method and apparatus for manufacturing such faired articles. In brief, the method and apparatus utilizes a special-shaped needle-like rod which is mounted inside of the ring of a braider and which reciprocates through the path of movement of the braid yarns as a jacket is braided over the core of a cable moving axially through the braider. The needle has an eye through which the fairing yarn is threaded, and the needle cooperates with a hook downstream of the braid-ring to produce loops which, upon movement of the braid yarns, are locked between the core and the jacket. Thereafter, the loops are preferably severed by a knife blade mounted downstream of the hook. The patents also disclose a method and apparatus for producing loops in a cable structure which does not include a central core.

While the method and apparatus disclosed in the aforementioned patents function entirely satisfactorily, the use of a reciprocating needle inside the braider ring is a factor limiting the rate of production of the cable, the spacing of the fairings, and the size of the cable and fairings. While there is a demand for small-diameter cables having a substantially continuous row of fairings projecting laterally thereform, heretofore, it has not been economically feasible to produce such cables by the method and apparatus disclosed in the aforementioned patents.

OBJECTS OF THE INVENTION

With the foregoing in mind, it is a primary object of the present invention to provide an improved method and apparatus for manufacturing faired ropes or cables.

It is another object of the present invention to provide a novel method and apparatus for producing faired ropes or cables economically at relatively-high production rates.

A further object of the present invention is to provide a unique method and apparatus which functions reliably and with a minimum of moving parts to produce faired ropes or cables.

Yet another object of the present invention is to provide a method and apparatus for producing a faired rope or cable having one or more lateral rows of substantially continuous relatively short fairing loops.

SUMMARY OF THE INVENTION

A faired rope or cable having at least one row of loops extending laterally therefrom is produced in a braider fitted with apparatus embodying the present invention. The braider has a braid ring around which braid yarns advance as a jacket is braided onto a core advancing centrally in a forward direction through the braider ring. An elongated nozzle having a central fairing-yarn guide tube surrounded by a pipe to provide an annular air chamber therebetween is mounted parallel with the path of movement of the core and has a nozzle terminating in close proximity with the upstream side of the braider ring. A fairing yarn is introduced into the rear end of the guide tube, and air under pressure is supplied in the air chamber. The air exits in a forward direction from the front end of the nozzle and entrains the fairing yarn therein to cause the same to be displaced through the path of movement of the braid yarns which, during movement around the braid ring in the conventional manner, causes the bases of the loops to be gripped by the jacket as it is braided onto the advancing core. Several such nozzles may be mounted in spaced relation around the periphery of the core if a cable having a series of rows of fairings is desired.

BRIEF DESCRIPTION OF THE DRAWING

The foregoing and other objects, features and advantages of the present invention should become apparent from the following description when taken in conjunction with the accompanying drawing, in which.

DESCRIPTION OF PREFERRED METHOD AND APPARATUS

In U.S. Pat. Nos. 3,975,980 and 4,030,401, both noted heretofore, there is disclosed a method and apparatus for manufacturing a faired rope or cable. While the patented method and apparatus is particularly suited for producing spaced fairings of substantial length for relatively-large diameter cables, there is a need to produce fairings of shorter height and/or greater continuity on relatively small diameter cables. It is, therefore, the thrust of the present invention to provide a method and apparatus for high-speed production of one or more continuous rows of loops or fairings extending lengthwise of a rope or cable.

Figure 1:
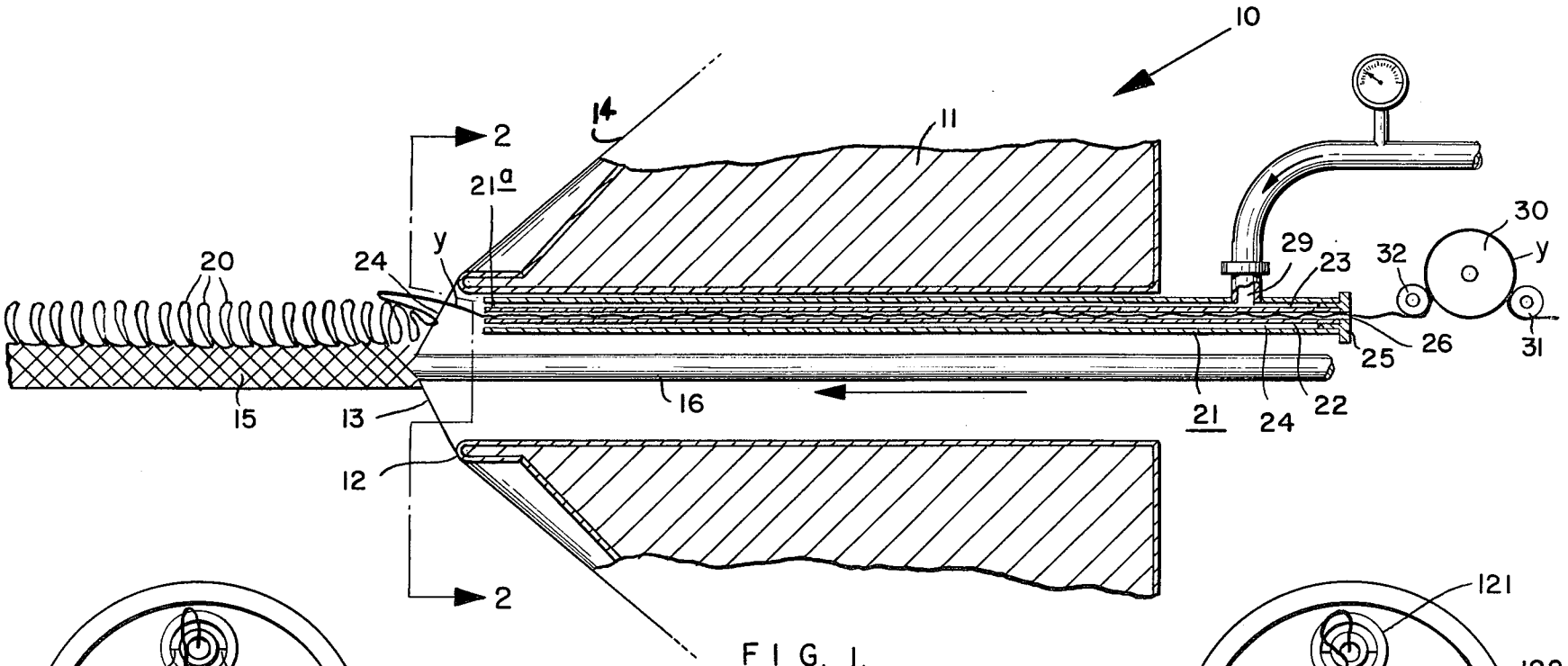
FIG. 1 is a schematic diagram of preferred apparatus for practicing the method of the present invention, the view illustrating schematically the ring of a conventional braider and the disposition of braid yarns relative to the ring during the braiding of a jacket and the formation of fairing loops as the core moves leftward in the direction of the arrow.

To this end, reference is made to FIG. 1 which illustrates apparatus 10 which is particularly suited for carrying out the method of the present invention. As seen therein, the apparatus 10 comprises a braider 11, such as the 24 Cable Carrier Braider manufactured by Wardwell Braiding Machine Company of Central Falls, R.I. The braider 11 has a braider ring 12 which guides a plurality of braid yarns 13, 14 in the customary manner in a conical path of movement toward the central longitudinal axis of the braider 11. The braider 11 operates in a conventional manner to braid a jacket 15 onto a core 16 which is advanced lengthwise coaxial with the axis of the braider 11 in the direction of the arrow in FIG. 1. While a vertical braider is preferred, for purposes of illustration, the braider is illustrated horizontal.

For the purpose of providing a row of loops 20,20 extending laterally along the length of the braided jacket 15, means is provided for displacing a length of fairing yarn Y through the path of movement of the braid yarns 13, 14 for causing the braid yarns 13 and 14 to operate on the fairing yarn Y to produce the loops 20,20 in a manner to be described. To this end, a nozzle assembly 21 is mounted inside the braider 11 in the manner illustrated in FIG. 1. The nozzle assembly 21 comprises an elongated cylindrical guide tube 22 disposed coaxially inside an elongated cylindrical pipe 23. The tube 22 and pipe 23 cooperate to form an elongated annular chamber 24 which is opened at its forward or left end and closed at its rear or right end by means of a plug 25. The tube 22 functions to guide the fairing yarn Y lengthwise in a forward direction along the advancing core 16.

Figure 2:
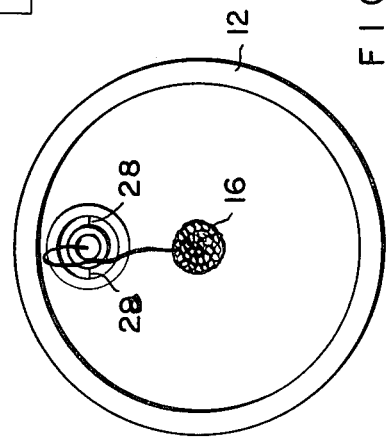
FIG. 2 is an enlarged sectional view taken on irregular line 2—2 of FIG. 1.

Both the guide tube 22 and its surrounding pipe 23 provide the nozzle assembly with a front end 21*a* which terminates in proximity with the braid ring 12. The tube 22 and pipe 23 are preferably maintained in spaced relation by separators 28 (FIG. 2). Thus, the tube 22 and pipe 23 cooperate to form a nozzle which functions to direct a tubular flow of fluid under pressure forwardly in a direction completely around the yarn Y substantially parallel with the path of movement of the core 16. In the present instance, the fluid includes a compressed gas, such as air, which is delivered to the annular chamber 24 of the nozzle assembly 21 through a lateral inlet 29 located at the rear end of the nozzle assembly 21. With this structure, the air exits the front end of the nozzle assembly 21 at a high velocity around the fairing yarn Y and causes the fairing yarn Y to be entrained within the air stream and displaced through the path of movement of the braid yarns 13 and 14. The braid yarns 13 and 14, as they advance around the braid ring 12 in a well-known manner, carry the fairing yarn Y down toward the core 16 to form the loops 20,20 which are interlocked among the braid yarns 13 and 14 and against the core 16. As a result, a substantially continuous row of loops 20,20 are provided along the braided jacket 15.

In order to control the height of the loops 20,20, the velocity of the fairing yarn Y in the nozzle assembly 21 is controlled. For this purpose, the fairing yarn Y is trained around a cot 30 and a pair of nips 31 and 32. The rotational velocity of the cot and nips are controlled in a well-known manner to adjust the speed at which the yarn Y enters the rear end of the nozzle assembly 21. It has been found that by regulating the velocity of the fairing yarn Y in relation to the velocity of the air stream issuing from the nozzle assembly 21, the velocity of the core 16 and the velocity of the braider 11, the height of the loops 20,20 can be controlled.

By way of example, and not by way of limitation, it has been found that loops 20,20 having a length of about one rope diameter have been produced at a speed of 300 ft. per hr. utilizing a nozzle assembly 21 comprising a tube 22 having a nominal inside diameter of $\frac{1}{8}$ inch and a pipe 23 having a nominal inside diameter of $\frac{1}{4}$ inch. Preferably, the front end 21*a* of the nozzle assembly 21 terminates about $\frac{1}{2}$ inch behind the working surface of the braid ring upstream of the path of movement of the braid yarns 13 and 14. Air under a pressure of 30–60 psi, and more preferably 45 psi, is introduced into the lateral inlet 29 for creating the yarn entraining air jet which exits from the front end of the nozzle assembly 21. Preferably, the fairing yarn Y is maintained under sufficient tension in the nozzle assembly 21 as to prevent any slack from forming between the nip rolls and the braid zone. The linear velocity of the fairing yarn Y varies, depending on the speed of the braider, the size of the rope or cable, loop size, and the size and type of jacket yarns used. Since the fairing yarn is formed into loops, however, the speed of the fairing yarn Y has to be significantly greater than the speed of the rope. For instance, in one run making $\frac{1}{4}$ in. loops on a $\frac{1}{4}$ in. diameter rope, the rope speed was 200 ft./hr. and the fairing yarn speed was 1800 ft./hr.

While various materials may be utilized for the core 16, the braid yarns 13 and 14, and the fairing yarn Y, a braided structure which has been produced satisfactorily on a $\frac{1}{4}$ in. diameter rope, includes a nylon fairing yarn of 840 denier composed of one or more strands. Polyester braid yarns 13 and 14 of 1,000 denier compose the braided jacket 15. Higher denier yarns would, of course, be preferable for ropes of larger diameter. Preferably, the core 16 comprises a modified braided structure such as sold under the trade designation Miniline by the assignee of the present application. The loops 20,20 may be left uncut as illustrated or they may be subsequently trimmed by a suitable cutting device should such be desirable.

Figure 3:
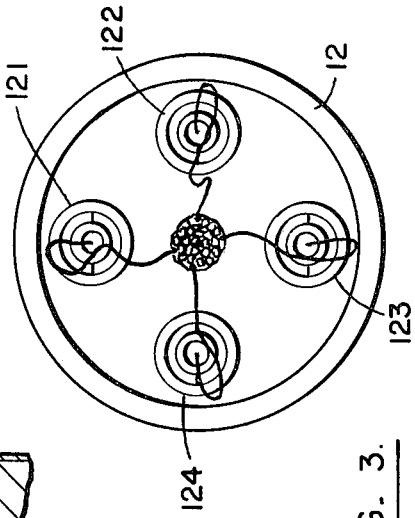
FIG. 3 is a view similar to FIG. 2 but illustrating a modified embodiment that the present invention utilized to produce a cable having a plurality of rows of loops.

Should it be desirable to produce a faired cable or rope having more than one row of loops, more than one nozzle assembly may be mounted inside the braider such as in the manner illustrated in FIG. 3. As illustrated therein, four nozzle assemblies 121–124 are mounted in equally spaced relation inside the periphery of the braider ring 12 in a manner similar to the nozzle assembly 21 for the purpose of producing a faired rope or cable having four rows of loops 20,20 extending along its length. It should be noted, however, that both the number and disposition of the nozzles may be varied depending upon the number of rows desired and their angular relationship relative to one another.

In view of the foregoing, it should be apparent that the present invention now provides an improved method and apparatus for producing a rope or cable having one or more rows of fairings making it particularly suited for use in undersea applications where a reduction in strumming, drag and cable fatigue due to underwater currents flowing across the cable is desirable. The method and apparatus comprises a minimum of moving parts and is, therefore, highly reliable in operation and economical to maintain. Furthermore, the method and apparatus enables relatively small diameter (less than about 1 in.) faired cables to be produced at much higher rates of production than heretofore has been possible by known techniques.

While a preferred method and apparatus for practicing the invention has been described in detail, various modifications, alterations and changes may be made without departing from the spirit and scope of the present invention as defined in the appended claims.

I claim:

1. In a method of manufacturing a faired article wherein fairing yarn loops are applied during braiding of a jacket as the jacket exits downstream from the ring of a braider, the improvement comprising the steps of:

guiding at least one length of a fairing yarn into proximity with the upstream side of the braider ring;

entraining said fairing yarn in a fluid stream directed across the path of movement of the braid yarns as they advance around the braider ring; and causing the fluid stream with said fairing yarn entrained therein to pass through the path of movement of the braid yarns as they advance and thereby enabling the braid yarns to form the fairing yarn into loops extending along the jacket structure.

2. The method according to claim 1 including the step of advancing a core centrally of the braider ring along the path of movement of the fairing yarn and braiding onto said core.

3. The method according to claim 1 wherein a plurality of lengths of fairing yarn are subjected to said guiding, entraining and causing steps at spaced locations relative to the inner periphery of the braider ring for creating a plurality of rows of said loops extending along said jacket.

4. The method according to claim 1 including the step of controlling the speed of movement of the fairing yarn upstream of the braider ring to control the height of the loops.

5. The method according to claim 1 wherein said fairing yarn is guided longitudinally in the direction of movement of the braided cable, and said fluid is directed in the same direction around the fairing yarn to entrain said fairing yarn and to displace the same through the braid yarns.

6. The method according to claim 1 wherein said fluid includes air under pressure.

7. In combination with a braider having a braider ring for guiding braid yarns in a conical path to form a braided structure, apparatus for forming a series of fairings along the braided structure, said apparatus comprising:

means for guiding at least one length of fairing yarn into close proximity with the path of movement of said braid yarns inwardly of said braider ring; and means providing a fluid jet adjacent said braider ring for entraining said fairing yarn and displacing the same through the braid yarns inwardly of said braider ring as the braid yarns advance;

whereby a series of fairing loops are provided along the length of the braided structure as it advances away from the braider.

8. Apparatus according to claim 7 wherein said guiding means includes an elongated tube disposed in the direction of movement of the braided structure and wherein said fluid jet providing means includes means providing a nozzle at the forward end of said tube for flowing said fluid around the fairing yarn and toward the braid yarns.

9. Apparatus according to claim 8 wherein said nozzle means includes a pipe receiving said tube lengthwise and forming an elongated annular chamber therebetween, and including means for admitting said fluid under pressure into said chamber upstream of said braider ring, and means remote from said braider ring for admitting said fairing yarn into said tube.

10. Apparatus according to claim 9 wherein said tube and pipe cooperate to define an annular orifice providing said nozzle means from which said fluid is discharged.

11. Apparatus according to claim 7 including means for guiding and providing fluid jets for a plurality of fairing yarns at spaced locations inside the periphery of said braider ring for forming a plurality of rows of loops along said braided structure.

* * * * *